US009079688B1

(12) United States Patent
Tapley

(10) Patent No.: US 9,079,688 B1
(45) Date of Patent: Jul. 14, 2015

(54) STORAGE BAG WITH REMOVABLE LOADING SHIELD TO PROTECT SEALABLE CLOSURES

(76) Inventor: Eugene Tapley, Chugiak, AK (US)

( * ) Notice: Subject to any disclaimer, the term of this patent is extended or adjusted under 35 U.S.C. 154(b) by 507 days.

(21) Appl. No.: 13/465,290

(22) Filed: May 7, 2012

(51) Int. Cl.
*B65D 33/00* (2006.01)

(52) U.S. Cl.
CPC ..... *B65D 33/007* (2013.01); *B65D 33/00* (2013.01)

(58) Field of Classification Search
CPC ..... B65D 33/00; B65D 33/007
USPC ..... 141/10, 114, 314–317, 331–345; 383/33, 34, 36, 210.1; 53/136.5
See application file for complete search history.

(56) References Cited

U.S. PATENT DOCUMENTS

| | | | | | |
|---|---|---|---|---|---|
| 2,430,155 | A * | 11/1947 | Buttery | 141/390 |
| 3,722,561 | A * | 3/1973 | O'Leary et al. | 141/316 |
| 3,746,215 | A * | 7/1973 | Ausnit et al. | 222/92 |
| 3,818,956 | A * | 6/1974 | Chamberlain | 141/316 |
| 4,248,278 | A * | 2/1981 | Blodgett | 141/316 |
| 4,279,749 | A * | 7/1981 | Moore | 210/330 |
| 5,354,132 | A * | 10/1994 | Young et al. | 383/49 |
| 5,979,842 | A * | 11/1999 | Fan | 248/99 |
| 6,345,911 | B1 * | 2/2002 | Young et al. | 383/6 |
| 6,527,444 | B1 * | 3/2003 | Buchman | 383/36 |
| 6,783,276 | B2 * | 8/2004 | Machacek et al. | 383/36 |

* cited by examiner

*Primary Examiner* — Timothy L Maust
(74) *Attorney, Agent, or Firm* — Michael J. Tavella

(57) ABSTRACT

A bag that has a pair of small plastic sheets that cover the sealing surfaces and act as shields during loading. When the bag is full, the user can pull a tab and remove the shield assembly completely. This leaves a normal bag with a seal that is clean and ready for use.

5 Claims, 7 Drawing Sheets

STORAGE BAG WITH REMOVABLE LOADING SHIELD TO PROTECT SEALABLE CLOSURES

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to seal-type closure bags and particularly to seal-type closure bags having removable loading shields.

2. Description of the Prior Art

Sealable closure bags have become the industry standard for almost all storage needs that utilize plastic bags. These bags have a two part seal that is made by compressing the top portion of the bags together. Although these bags come in all sizes, most people use the standard quart and gallon size bags for food storage. One of the most important factors in proper food storage is ensuring that the seal surfaces remain clean so that a good seal can be made. Contamination from the food can lead to an improper seal, which allows air and bacteria to enter the bag. The contamination may also lead to mold forming on the bag if the bag is left in storage for long time. This mold may be able to penetrate into the bag and ruin the food inside.

Obviously, a user can wipe the sealing surface before making the seal. However, for a large storage job that uses many bags, it is not easy or convenient to have to clean each and every bag. To date, no one has apparently provided a simple way to protect the seals on the bags when loading foods that can contaminate them.

BRIEF DESCRIPTION OF THE INVENTION

The instant invention overcomes these difficulties. It is a bag that has a pair of small plastic sheets that cover the sealing surfaces and act as shields during loading. When the bag is full, the user removes the shield assembly completely. This leaves a normal bag with a seal that is clean and ready for use.

DETAILED DESCRIPTION OF THE INVENTION

Figure 1:
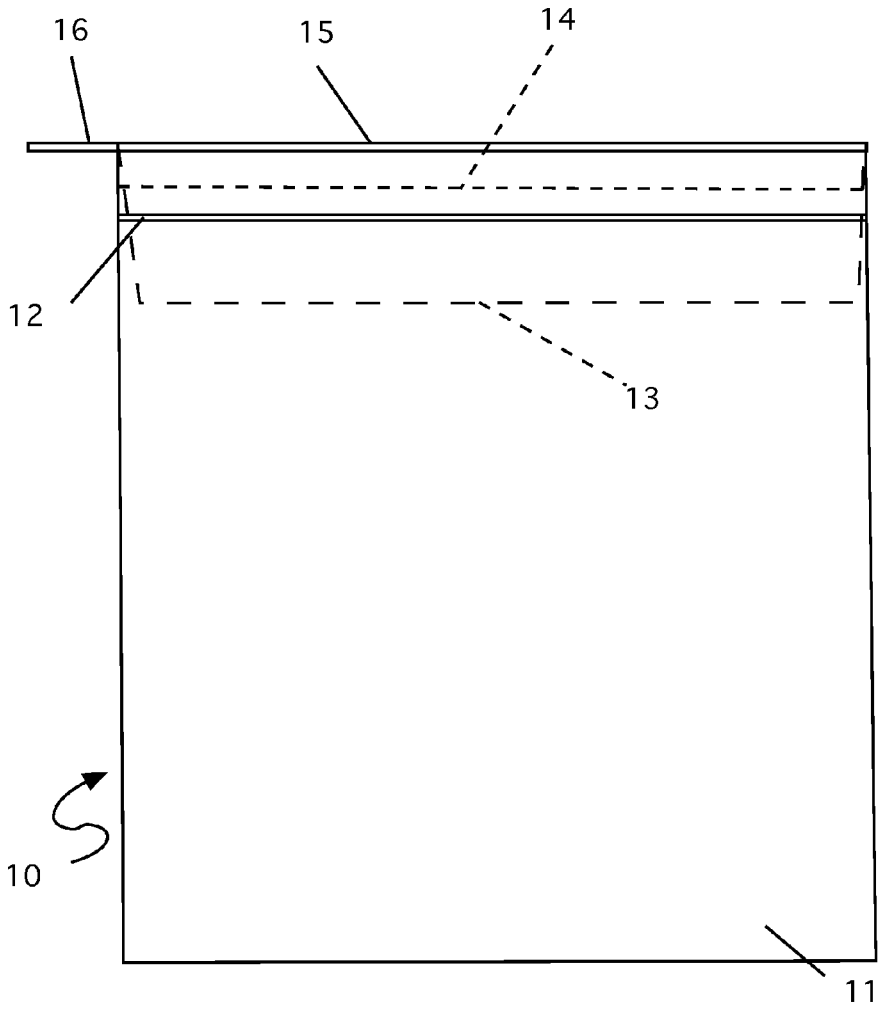
FIG. 1 is a front view of a bag with the invention installed prior to use.
Figure 1A:
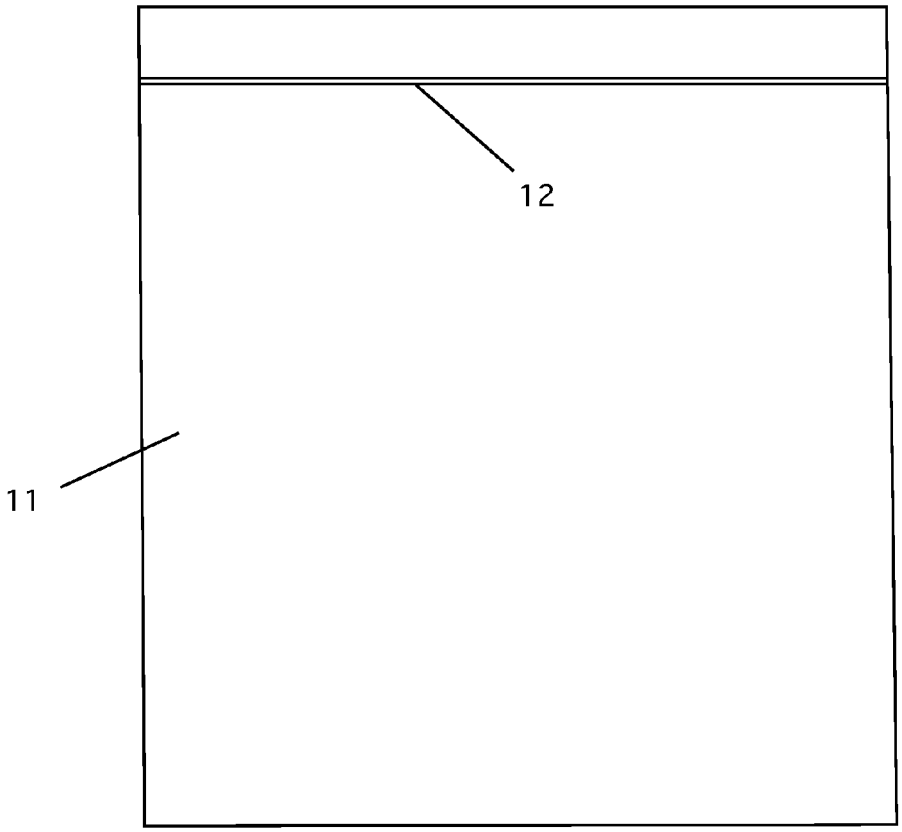
FIG. 1*a* is a front view of the bag with the shield removed.

Referring now to FIG. 1 a front view of a bag with the invention installed prior to use. Here, the device 10 has a lower bag portion 11, a seal portion 12 that is any of the standard type zip-seals for storage bags. To that bag, a shield 13 that has two pieces (see FIG. 5) and that extends downward over the seal portion 12 is attached to the top of the bag with a perforation 14 that allows the shield to be removed. At the top of the shield is a thick strip of resilient plastic 15 that is used to prop the top of the bag open, as discussed below, for filling. The plastic strip 15 has an end tab 16 that is used to open the bag for filling. Once the bag is filled, the shield and strip portions are removed and the bag can then be sealed and used as any other storage bag. FIG. 1*a* shows the bag 10 with the shield removed.

Figure 2:
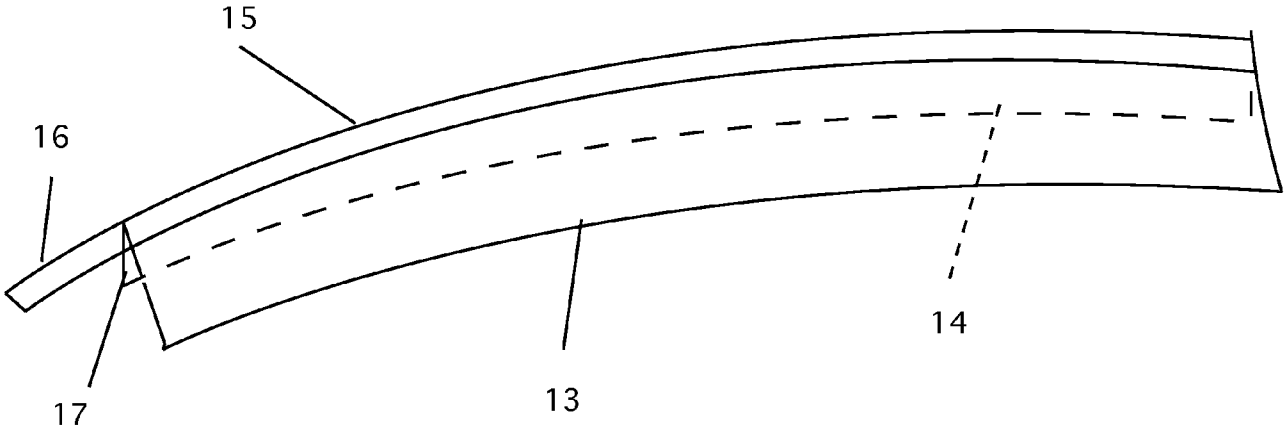
FIG. 2 is a perspective detail view of one-half of the shield showing the extended portion of the top plastic strip.

FIG. 2 is a perspective detail view of one-half of the shield showing the extended portion of the top plastic strip. In this view, one side of the shield 13 and associated structures are shown. The shield 13 is shown extending down from the thick strip of resilient plastic 15. The tab 16 is shown extending past the edge of the shield as shown. Also shown in this figure is the perforated edge 14 that forms the attachment point for the shield to the bag. Points 17 are the edges that attach this half of the shield to the other side of the shield. Note that the shield 13 extends into the bag and, as noted, covers the seal portions of the bag.

Figure 3:
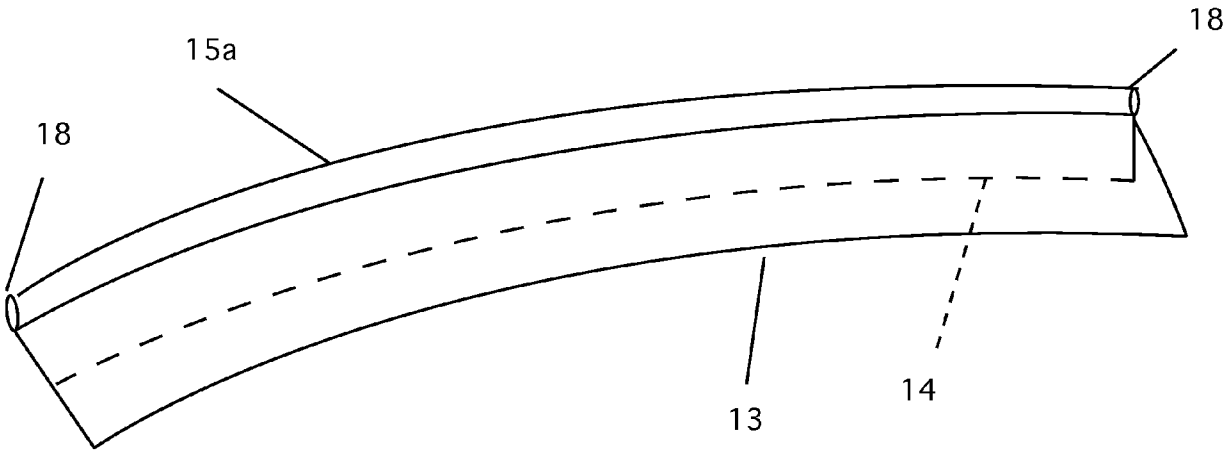
FIG. 3 is a perspective detail view of the other half of the shield.

FIG. 3 is a perspective detail view of the other half of the shield. In this figure, the shield 13 is shown as before. The perforation 14 is also shown. At the top of the shield is a second thick strip of resilient plastic 15*a*. This strip has no extension piece. The ends 18 are secured (welded) to the ends of the other side of the shield to form the complete assembly.

Figure 4:
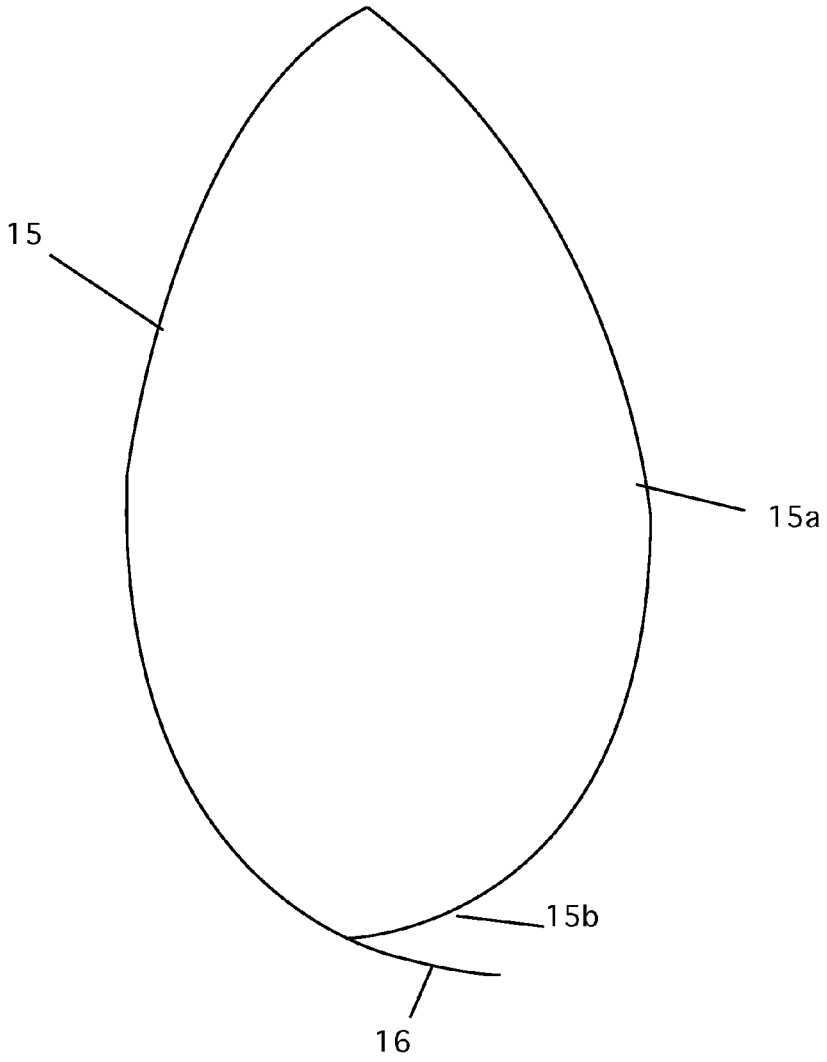
FIG. 4 is a top detail view of the device showing the operation of the thick plastic strip that is used to hold the bag open prior to loading.

FIG. 4 is a top detail view of the device showing the operation of the thick plastic strip that is used to hold the bag open prior to loading. The plastic material in these strips is a resilient material that has a spring-like bendable characteristic.

FIG. 4 shows the open top without the bag and shields. The thick plastic strips 15 and 15*a* are shown in the bent open position. This is achieved by folding and pressing the tab 16 inward towards the area marked 15*b*. As the tab is moved, the thick strips of resilient plastic bend outwardly as shown. The bag can thus be held open by holding the tab 16 against the area 15*b*. It is easy to load the bag with the bag held open. Once loaded, the tab 16 is released. The thick strip of resilient plastic will spring back to a closed position. The user can then pull the shields (including the plastic strips) from the bag at the perforation points and the bag can be sealed normally.

Figure 5:
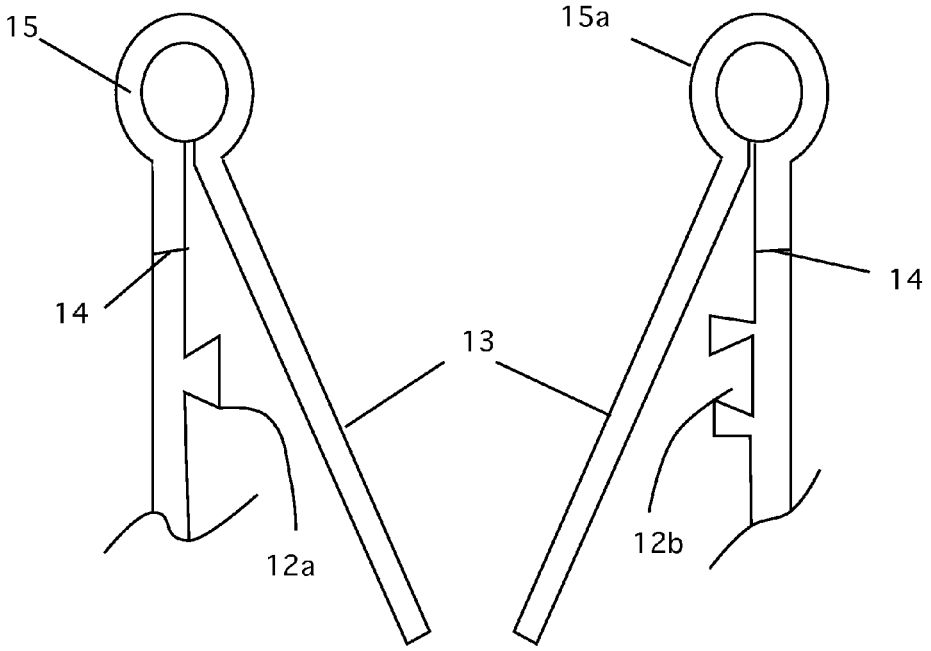
FIG. 5 is an enlarged cross-sectional view of the shield and seal portion of the bag.

FIG. 5 is an enlarged cross-sectional view of the shield and seal portion of the bag. Here, the thick strips of resilient plastic 15 and 15*b* are shown. The shields 13 extend inward and downward as shown, covering the sealing portions 12*a* and 12*b*. Note that sealing portions 12*a* and 12*b* illustrate one form of seal. This seal can be modified to any particular form as desired. Above the sealing portions 12*a* and 12*b* are the perforations 14.

Figure 5A:
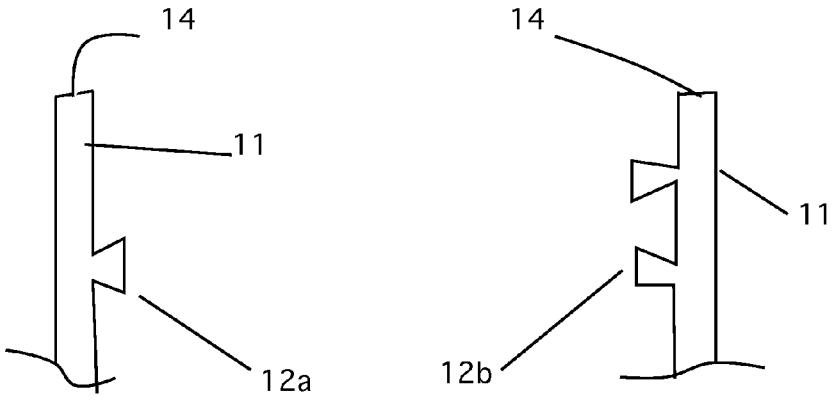
FIG. 5*a* an enlarged cross-sectional view that shows the bag with the sealing portions removed at the perforations.

FIG. 5*a* an enlarged cross-sectional view that shows the bag with the sealing portions removed at the perforations.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A removable shield for a storage bag having an inside portion and a pair of oppositely disposed sealable tops, each of said sealable tops having two sides and a top surface, comprising:

a) a first shield having a thickness, removably attached to the top surface of one of said two sealable tops of said storage bag such that said shield extends downward inside said bag, completely covering one of said pair of oppositely disposed sealable tops;

b) a first strip of resilient material having a thickness greater than the thickness of said first shield, attached to said first shield, said first strip of resilient material having an end extension piece formed thereon and extending outwardly therefrom;

c) a second shield having a thickness, removably attached to the top surface of the other of said pair of oppositely disposed sealable tops such that said second shield extends downward inside said bag, completely covering the other of said pair of oppositely disposed sealable tops; and d) a second strip of resilient material having a thickness greater than the thickness of said second shield, attached to said second shield.

2. The removable shield for storage bags of claim 1 further comprising a means for removing said first and said second shields from said storage bag.

3. The removable shield for storage bags of claim 2 wherein the means for removing said first and said second shields comprises a perforated line formed on said two sides of said storage bag connecting said first and second shields to said storage bag.

4. The removable shield for storage bags of claim 1 wherein said first and second strips of resilient material have a spring-like bendable characteristic.

5. The removable shield for storage bags of claim 4 wherein said first and second strips of resilient material are plastic.

* * * * *